US008722609B2

(12) United States Patent
Choczaj et al.

(10) Patent No.: US 8,722,609 B2
(45) Date of Patent: May 13, 2014

(54) LIMESCALE AND SOAP SCUM REMOVING COMPOSITION CONTAINING METHANE SULFONIC ACID

(75) Inventors: Barbara G. Choczaj, Apple Valley, MN (US); Michael J. Bartelme, Eden Prairie, MN (US); Steven E. Lentsch, St. Paul, MN (US); Katherine O. Vetter, West Saint Paul, MN (US); Marvin C. Trulsen, Woodbury, MN (US); Erik C. Olson, Savage, MN (US); Mark D. Levitt, Lake Elmo, MN (US)

(73) Assignee: Ecolab Inc, Eagan, MN (US)

( * ) Notice: Subject to any disclaimer, the term of this patent is extended or adjusted under 35 U.S.C. 154(b) by 772 days.

(21) Appl. No.: 12/419,145

(22) Filed: Apr. 6, 2009

(65) Prior Publication Data

US 2009/0260659 A1 Oct. 22, 2009

Related U.S. Application Data

(60) Provisional application No. 61/042,580, filed on Apr. 4, 2008.

(51) Int. Cl.

| | |
|---|---|
| ***C11D 3/43*** | (2006.01) |
| ***C11D 3/20*** | (2006.01) |
| *C11D 3/34* | (2006.01) |

(52) U.S. Cl.

CPC ..... *C11D 3/2079* (2013.01); *C11D 3/2075* (2013.01); *C11D 3/3418* (2013.01); *C11D 3/43* (2013.01)

USPC ..... 510/362; 510/191; 510/238; 510/253

(58) Field of Classification Search

CPC .. C11D 3/2075; C11D 3/2079; C11D 3/3418; C11D 3/43

USPC ..... 510/191, 238, 362, 253

See application file for complete search history.

(56) References Cited

U.S. PATENT DOCUMENTS

| | | | | |
|---|---|---|---|---|
| 4,923,523 | A | 5/1990 | Schluessler | |
| 5,554,211 | A * | 9/1996 | Bokisa et al. | 106/1.22 |
| 5,672,578 | A * | 9/1997 | Carrie et al. | 510/245 |
| 5,677,271 | A * | 10/1997 | Bianchetti et al. | 510/253 |
| 5,698,087 | A * | 12/1997 | Bokisa | 205/254 |
| 5,756,443 | A * | 5/1998 | Inoue et al. | 510/238 |
| 5,912,219 | A * | 6/1999 | Carrie et al. | 510/238 |
| 5,977,054 | A | 11/1999 | Wierenga | |
| 6,001,792 | A | 12/1999 | Vos | |
| 6,063,172 | A * | 5/2000 | Bokisa et al. | 428/577 |
| 6,673,760 | B1 | 1/2004 | Lentsch et al. | |
| 6,992,053 | B2 * | 1/2006 | Cermenati et al. | 510/238 |
| 7,326,675 | B2 * | 2/2008 | Schneiderman et al. | 510/427 |
| 7,341,983 | B2 | 3/2008 | Pedersen et al. | |
| 8,410,038 | B2 * | 4/2013 | Davister et al. | 510/191 |
| 2002/0193270 | A1 | 12/2002 | Cermenati et al. | |
| 2002/0193278 | A1 * | 12/2002 | Cermenati et al. | 510/465 |
| 2004/0154640 | A1 | 8/2004 | Smith et al. | |
| 2008/0139443 | A1 * | 6/2008 | Buzinski et al. | 510/362 |
| 2011/0061680 | A1 * | 3/2011 | Davister et al. | 134/6 |

FOREIGN PATENT DOCUMENTS

| | | |
|---|---|---|
| EP | 656417 A1 | 6/1995 |
| EP | 666303 A1 | 8/1995 |
| EP | 666304 A1 | 8/1995 |
| EP | 666305 A1 | 8/1995 |

OTHER PUBLICATIONS

Brochure entitled "The 'Green' Acid for Use in Cleaners", BASF, 16 pages.

Brochure entitled "New Application Involving Methanesulfonic Acid", BASF, 12 pages.

International Search Report and Written Opinion issued in PCT/US2009/039663, mailed Aug. 7, 2009, 11 pages.

* cited by examiner

*Primary Examiner* — Gregory Webb

(74) *Attorney, Agent, or Firm* — Amy J. Hoffman

(57) ABSTRACT

A cleaning composition including an acid component is provided, along with methods for using the composition to remove soil from hard surfaces. The concentrate cleaning composition includes between about 1 and about 70 wt % of methane sulfonic acid, about 0.1 to about 15 wt % of a surfactant component, up to about 90% of a solvent and other adjuvants.

3 Claims, No Drawings

LIMESCALE AND SOAP SCUM REMOVING COMPOSITION CONTAINING METHANE SULFONIC ACID

CROSS-REFERENCE TO RELATED APPLICATION

This application claims the benefit to U.S. Provisional Application No. 61/042,580, filed on Apr. 4, 2008, entitled "Limescale And Soap Scum Removing Composition Containing Methanesulfonic Acid" which is incorporated herein by reference in its entirety.

TECHNICAL FIELD

The present invention relates to a cleaning composition including alkyl sulfonic acids, such as methane sulfonic acid, and to methods of using this composition for removing limescale and soap scum from hard surfaces and bathroom fixtures.

BACKGROUND

Tap water typically contains salts such as calcium carbonate that deposit on hard surfaces, for example, on bathroom fixtures with a decorative or protective coating applied by physical vapor deposition and the like. Limescale deposits are usually removed using an acidic composition that can dissolve away the mineral deposit. Usually, such a composition contains phosphoric acid, which can be corrosive. Further, bathroom soils contain soap scum in addition to mineral deposits, and the presence of soap scum interferes with compositions currently used to remove limescale.

There remains a need for improved cleaning compositions effective against limescale and soap scum on bathroom surfaces.

SUMMARY

The present invention includes a method of removing soil on an object, specifically a hard surface. The method includes contacting the hard surface with a solution including a concentrate cleaning composition and rinsing the hard surface. The concentrate cleaning composition includes about 1 to about 70 wt % of a short chain alkane sulfonic acid composition, about 0.1 to about 20 wt % of a surfactant and up to about 90 wt % of a solvent. In one embodiment, the short chain alkane sulfonic acid composition is methane sulfonic acid.

The present invention also relates to cleaning compositions containing short chain alkane sulfonic acids for removing soil from a hard surface. The cleaning composition includes about 1 to about 70 wt % of methane sulfonic acid, about 0.1 to about 20 wt % of a surfactant and up to about 90 wt % of a solvent.

DETAILED DESCRIPTION

Sulfonic Acid Containing Compositions and Methods Employing them

The present invention relates to cleaning compositions and methods of using the compositions for cleaning and removing organic soils from an object or surface. The compositions include a short chain alkane sulfonic acid containing from 1 to 4 carbon atoms, such as methane sulfonic acid (MSA). In one embodiment, the acid compositions are substantially free of phosphoric acid and minimize the amount of corrosion to the surface being cleaned. In an embodiment, the acid composition can form a clear and stable use solution. The cleaning compositions can be used in various hard-surface cleaning applications, including, for example: cleaning bathroom surfaces, cleaning dishwashing equipment and laundering. The cleaning composition can also be used in various industries, including, but not limited to: warewash, food and beverage, vehicle care and health care.

In an embodiment, the short chain alkane sulfonic acid is methane sulfonic acid (MSA). Although not limiting to this invention, it has been found that short chain alkane sulfonic acids like MSA, for example, are capable of removing mineral soils from surfaces in addition to organic soils because of the high acidity of the short chain alkane sulfonic acids. In addition, it has been found that, in contrast to the use of other acid compositions, there is less corrosion produced on coated metal surfaces when short chain alkane sulfonic acids are used, and that the use of short chain alkane sulfonic acids also produces fewer aesthetic defects than treatment with other acids. MSA provides a green, readily biodegradable and odor free replacement for conventional cleaning surfactants such as phosphoric acid and other organic acids. In one embodiment, less than about one-third of the amount of active MSA is needed to exhibit similar cleaning properties as phosphoric acid.

In one aspect, the cleaning compositions containing alkane sulfonic acids such as MSA can be used to clean objects and/or remove soils or deposits from hard surfaces. The cleaning compositions are effective for removing mineral and organic deposits, such as limescale and soap scum, for example, from hard surfaces without significant corrosive effect, and without any detrimental effect on the aesthetics of such surfaces. The limescale removing capacity of the cleaning composition depends in part on the pH. In one embodiment, when the cleaning composition is used to clean, for example, limescale and/or soap scum, the pH of the cleaning composition including a short-chain alkane sulfonic acid is between about 0.1 and about 5 and particularly between about 0.9 and about 2.5. When the cleaning composition is used in the field of health care to clean, for example, biomass and scale from surgical instruments, an exemplary pH range of the cleaning composition is between about 1 and about 9. In the neutral range, the cleaning composition will remove biomass from the surface of the instruments. In the acidic range, the cleaning composition will also remove scale from the surface of the instruments.

In an embodiment, the present compositions combine acid components with surfactants to provide effective cleaning for hard surfaces in the bathroom, including bathroom fixtures, and fixtures coated by physical vapor deposition (PVD). The surfactant may be, for example, a biocidal surfactant. In another embodiment, the present compositions are effective for cleaning other hard surfaces where limescale and soap scum are known to accumulate, such as on the interior surfaces of dishwashing equipment, for example.

According to the invention, short-chain alkane sulfonic acids containing from 1 to 4 carbon atoms are employed in the cleaning compositions of the invention. Suitable short chain alkane sulfonic acids include, for example, methane sulfonic acid, ethane sulfonic acid, n- and i-propane sulfonic acid, n-, i- and tert-butane sulfonic acid, or mixtures thereof. According to the invention, the short chain alkane sulfonic acids can be used either individually or in the form of mixtures in cleaning compositions.

In an embodiment, the cleaning compositions include methane sulfonic acid (MSA). It has surprisingly been found that methane sulfonic acid has a foamy texture or appearance.

Although not limiting to the present invention, MSA may therefore have surfactant effect that contributes to its efficacy as a cleaner. In addition, MSA is surprisingly effective at retaining the original appearance of metal surfaces without causing corrosion or aesthetic defects sometimes caused by cleaning with other acidic compositions.

In concentrate form, the cleaning compositions include short chain alkane sulfonic acids at concentrations of between about 1 to about 70 wt-%, particularly between about 2 to about 40 wt-% and more particularly between about 4 to about 25 wt-%. In one embodiment, the short chain alkane sulfonic acids may be present in a use solution at concentrations of between about 0.01 to about 30 wt %, particularly between about 0.1 to about 5 wt-%, more particularly between about 0.25 and about 2.5 wt-% and even more particularly between about 0.25 and about 1 wt %. In other embodiments, similar intermediate concentrate and use concentrations may also be present in the cleaning compositions of the invention.

In embodiments, the acid composition of the present invention is a combination of short chain alkane sulfonic acids with 1 to 4 carbon atoms and short- to medium-chain carboxylic acids, such as, but not limited to, an alkanoic acid. An example of a suitable alkanoic acid includes, but is not limited to, octanoic acid. A medium-chain carboxylic acid is defined as having between about 6 carbon atoms and about 12 carbon atoms. In an aspect, the acid component of the cleaning composition is a combination of methane sulfonic acid and octanoic acid. The concentrate acid combinations of the invention are used at concentrations of between about 1 to about 70 wt-%, particularly between about 2 to about 40 wt-% and more particularly between about 4 to about 25 wt-%. When used in use solutions, the acid component may be present in a use solution at concentrations of between about 0.01 to about 30 wt %, particularly between about 0.1 to about 5 wt-%, more particularly between about 0.25 and about 2.5 wt-% and even more particularly between about 0.25 and about 1 wt %. In other embodiments, similar intermediate concentrations of the cleaning preparations of the invention are present.

The cleaning compositions of the present invention are substantially free of phosphorus-containing compounds, making the detergent composition more environmentally acceptable. Phosphorus-free refers to a composition, mixture, or ingredients to which phosphorus-containing compounds are not added. Should phosphorus-containing compounds be present through contamination of a phosphorus-free composition, mixture, or ingredient, the level of phosphorus-containing compounds in the resulting composition is less than approximately 0.5 wt %, less than approximately 0.1 wt %, and often less than approximately 0.01 wt %.

Accordingly, cleaning preparations and disinfectants containing short-chain alkane sulfonic acids which are free from phosphorus (phosphate) and which, in addition, are less corrosive to metal surfaces, and do not produce aesthetic defects on metal surfaces, fall within the scope of the present invention.

Additional Functional Materials

The cleaning composition can include additional components or agents, such as additional functional materials. As such, in some embodiments, the cleaning composition including the short chain alkane sulfonic acid may provide a large amount, or even all of the total weight of the cleaning composition, for example, in embodiments having few or no additional functional materials disposed therein. The functional materials provide desired properties and functionalities to the cleaning composition. For the purpose of this application, the term "functional materials" include a material that when dispersed or dissolved in a use and/or concentrate solution, such as an aqueous solution, provides a beneficial property in a particular use. The cleaning preparations containing short chain alkane sulfonic acids may optionally contain other soil-digesting components, surfactants, disinfectants, sanitizers, acidulants, complexing agents, corrosion inhibitors, foam inhibitors, dyes, thickening or gelling agents, and perfumes, as described, for example, in U.S. Pat. No. 7,341,983, incorporated herein by reference. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Surfactants

The cleaning composition can contain an anionic surfactant component that includes a detersive amount of an anionic surfactant or a mixture of anionic surfactants. Anionic surfactants are desirable in cleaning compositions because of their wetting and detersive properties. The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the cleaning composition can have an alkyl group that contains 6 to 24 carbon atoms and the aryl group can be at least one of benzene, toluene, and xylene. An suitable alkyl aryl sulfonate includes linear alkyl benzene sulfonate. A suitable linear alkyl benzene sulfonate includes linear dodecyl benzyl sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. A suitable secondary alkane sulfonate includes sodium $C_{14}$-$C_{17}$ secondary alkyl sulfonate commercially available as Hostapur SAS from Clariant.

Suitable alkyl methyl ester sulfonates that can be used in the cleaning composition include those having an alkyl group containing 6 to 24 carbon atoms. Suitable alpha olefin sulfonates that can be used in the cleaning composition include those having alpha olefin groups containing 6 to 24 carbon atoms.

Suitable alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. A suitable alkoxy group is ethoxy. A suitable alkyl ether sulfate is sodium lauric ether ethoxylate sulfate and is available under the name Steol CS-460.

Suitable alkyl sulfates that can be used in the cleaning composition include those having an alkyl group containing 6 to 24 carbon atoms. Suitable alkyl sulfates include sodium laurel sulfate and sodium laurel/myristyl sulfate.

Suitable alcohol sulfates that can be used in the cleaning composition include those having an alcohol group containing about 6 to about 24 carbon atoms.

The anionic surfactant can be neutralized with an alkaline metal salt, an amine, or a mixture thereof. Suitable alkaline metal salts include sodium, potassium, and magnesium. Suitable amines include monoethanolamine, triethanolamine, and monoisopropanolamine. If a mixture of salts is used, an suitable mixture of alkaline metal salt can be sodium and magnesium, and the molar ratio of sodium to magnesium can be between about 3:1 and about 1:1.

The cleaning composition, when provided as a concentrate, can include the anionic surfactant component in an amount sufficient to provide a use composition having desired wetting and detersive properties after dilution with water. In general, the concentrate can be provided as a solid or as a liquid. When the concentrate is provided as a liquid, it can be provided in a form that is readily flowable so that it can be pumped or aspirated. It is additionally desirable to minimize the amount of water while preserving the flowable properties of the concentrate when it is provided as a liquid. The concentrate can contain about 0.1 wt-% to about 0.5 wt-%, about 0.1 wt-% to about 1.0 wt-%, about 1.0 wt-% to about 5 wt-%, about 5 wt-% to about 10 wt-%, about 10 wt % to about 20 wt-%, 30 wt-%, about 0.5 wt-% to about 25 wt-%, and about 1 wt-% to about 15 wt-%, and similar intermediate concentrations of the anionic surfactant.

The cleaning composition can contain a nonionic surfactant component that includes a detersive amount of nonionic surfactant or a mixture of nonionic surfactants. Nonionic surfactants can be included in the cleaning composition to enhance grease removal properties. Although the surfactant component can include a nonionic surfactant component, it should be understood that the nonionic surfactant component can be excluded from the detergent composition, if desired.

Nonionic surfactants that can be used in the composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants comprise a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. An suitable average molecular weight range of useful surfactants can be about 1,000 to about 40,000 and the weight percent content of ethylene oxide can be about 10-80 wt-%.

Additional nonionic surfactants include alcohol alkoxylates. An suitable alcohol alkoxylate include linear alcohol ethoxylates such as Tomadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from BASF), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauramide diethanolamide, cocoamide diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucocides, or mixtures thereof.

When nonionic surfactants are included in the detergent composition concentrate, they can be included in an amount of at least about 0.1 wt-% and can be included in an amount of up to about 15 wt-%. The concentrate can include about 0.1 to 1.0 wt-%, about 0.5 wt-% to about 12 wt-% or about 2 wt-% to about 10 wt-% of the nonionic surfactant.

Amphoteric surfactants that can be used to provide desired detersive properties. Suitable amphoteric surfactants that can be used include the betaines, imidazolines, and propionates. Suitable amphoteric surfactants include sultaines, amphopropionates, amphrodipropionates, aminopropionates, aminodipropionates, amphoacetates, amphodiacetates, and amphohydroxypropylsulfonates.

The detergent composition concentrate can be provided without any amphoteric surfactant. When the detergent composition includes an amphoteric surfactant, the amphoteric surfactant can be included in an amount of about 0.1 wt-% to about 15 wt-%. The concentrate can include about 0.1 wt-% to about 1.0 wt-%, 0.5 wt-% to about 12 wt-% or about 2 wt-% to about 10 wt-% of the amphoteric surfactant.

The cleaning composition can contain a cationic surfactant component that includes a detersive amount of cationic surfactant or a mixture of cationic surfactants. The cationic surfactant can be used to provide sanitizing properties. Although the surfactant component can include a cationic surfactant component, it should be understood that the cationic surfactant component can be excluded from the detergent composition, if desired.

Cationic surfactants that can be used in the detergent composition include, but are not limited to: amines such as primary, secondary and tertiary monoamines with $C_{1-8}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride.

The cleaning composition can contain a zwitterionic surfactant component that includes a detersive amount of zwitterionic surfactant or a mixture of zwitterionic surfactants. Although the surfactant component can include a zwitterionic surfactant component, it should be understood that the zwitterionic surfactant component can be excluded from the detergent composition, if desired.

Examples of zwitterionic surfactants that can be used in the detergent composition include, but are not limited to: betaines, imidazolines, and propionates.

Solvent or Water Component

The concentrate can be provided in the form of a solid, a liquid, or gel, or a combination thereof. The concentrate can be formulated without any water or can be provided with a relatively small amount of water in order to reduce the expense of transporting the concentrate. When the concentrate is provided as a liquid, it may be desirable to provide it in a flowable form so that it can be pumped or aspirated. It has been found that it is generally difficult to accurately pump a small amount of a liquid. It is generally more effective to pump a larger amount of a liquid. Accordingly, although it is desirable to provide the concentrate with as little as possible in order to reduce transportation costs, it is also desirable to provide a concentrate that can be dispensed accurately. As a result, a concentrate according to the invention, when it includes water, it can include water in an amount of about 0.1 wt-% to about 99 wt-%, about 30 wt-% to about 95 wt-%, and about 40 wt-% to about 90 wt-%.

It should be understood that the water provided as part of the concentrate can be relatively free of hardness. It is expected that the water can be deionized to remove a portion of the dissolved solids. The concentrate is then diluted with water available at the locale or site of dilution and that water may contain varying levels of hardness depending upon the locale. Although deionized can be used for formulating the concentrate, the concentrate also can be formulated with water that has not been deionized. That is, the concentrate can be formulated with water that includes dissolved solids, and can be formulated with water that can be characterized as hard water.

Additional Acidulant

The acid compositions of the present invention have pKa values of less than or equal to 3. The detergent composition can include an additional acidulant. In an aspect, suitable additional acidulants or acids include organic acids. For example, suitable organic acids include lactic acid, citric acid, propionic acid, acetic acid, hydroxyacetic acid, formic acid, glutaric acid, malic acid, hydroxy propionic acid, succinic acid, glutaric acid, adipic acid, fumaric acid, mixtures thereof, or the like. The organic acid can be a mixture of adipic, malic, and succinic acids sold under the tradename Sokalan. In an embodiment, the acid includes citric acid, lactic acid, urea hydrochloride, or a mixture thereof. In another aspect, suitable acids include inorganic or mineral acids, such as, for example, hydrochloric acid, nitric acid, sulfuric acid, sulfamic acid, urea dihydrogen sulfate and mixtures thereof, or the like, but not including phosphoric acid. In an embodiment, the present invention includes a combination of acidulants, such as, for example, citric acid, lactic acid, urea hydrochloride, or a mixture thereof.

The additional acidulant or acid can be present in the composition at about 0.01 to about 85 wt-%, about 0.1 to about 70 wt-%, about 0.3 to about 3 wt-%, or about 1 to about 5 wt-%.

Thickening Agents

Thickeners useful in the present invention include those compatible with acidic systems. The viscosity of the composition increases with the amount of thickening agent, and viscous compositions are useful for uses where the cleaning composition clings to the surface. Suitable thickeners can include those which do not leave contaminating residue on the surface to be treated. Generally, thickeners which may be used in the present invention include natural gums such as xanthan gum, guar gum, modified guar, or other gums from plant mucilage; polysaccharide based thickeners, such as alginates, starches, and cellulosic polymers (e.g., carboxymethyl cellulose, hydroxyethyl cellulose, and the like); polyacrylates thickeners; and hydrocolloid thickeners, such as pectin. Generally, the concentration of thickener employed in the present compositions or methods will be dictated by the desired viscosity within the final composition. However, as a general guideline, the viscosity of thickener within the present composition ranges from about 0.1 wt-% to about 3 wt-%, from about 0.1 wt-% to about 2 wt-%, or about 0.1 wt-% to about 0.5 wt-%.

Dyes and Fragrances

Various dyes, odorants including perfumes, and other aesthetic enhancing agents may also be included in the composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), Pylakor Acid Bright Red (Pylam), and the like. Fragrances or perfumes that may be included in the compositions include, for example, terpenoids such as citronellol, aldehydes such as amyl cinnamaldehyde, a jasmine such as C1S-jasmine or jasmal, vanillin, and the like.

Adjuvants

The present composition can also include any number of adjuvants. Specifically, the composition can include stabilizing agents, wetting agents, thickeners, foaming agents, corrosion inhibitors, biocides, hydrogen peroxide, pigments or dyes among any number of other constituents which can be added to the composition. Such adjuvants can be preformulated with the present composition or added to the system simultaneously, or even after, the addition of the present composition. The composition can also contain any number of other constituents as necessitated by the application, which are known and which can facilitate the activity of the present compositions.

Embodiments of the Present Compositions

Several suitable exemplary concentrate compositions are provided in the following tables.

TABLE 1

Exemplary Composition #1: Suitable Limescale Removal Composition

| Components | Approximate Range of Concentration (Wt %) |
|---|---|
| Solvent | 70-90 |
| Thickening agent | 0.1-5.0 |
| Surfactant | 0.1-20 |
| Acid component | 2-40 |
| Dye | 0.0001-0.1 |
| Fragrance | 0.01-2 |

TABLE 2

Exemplary Composition #2: Suitable Limescale Removal Composition

| Components | Approximate Range of Concentration (Wt %) |
|---|---|
| Solvent | 70-90 |
| Surfactant | 0.1-20 |
| Acid component | 2-40 |
| Dye | 0.0001-0.1 |

TABLE 3

Exemplary Composition #3: Suitable Limescale Removal Composition

| Components | Approximate Range of Concentration (Wt %) |
|---|---|
| Solvent | 70-90 |
| Thickening agent | 0.1-5.0 |
| Surfactant | 0.1-20 |
| Acid component | 2-40 |
| Dye | 0.0001-0.1 |

TABLE 4

| Exemplary Composition #4: Suitable Soap Scum Removal Composition | |
|---|---|
| Components | Approximate Range of Concentration (Wt %) |
| Solvent | 70-90 |
| Acidulant | 5-15 |
| Surfactant | 0.1-20 |
| Acid component | 2-40 |
| Dye | 0.0001-0.1 |

TABLE 5

| Exemplary Composition #5: Suitable Soap Scum Removal Composition | |
|---|---|
| Components | Approximate Range of Concentration (Wt %) |
| Solvent | 70-90 |
| Acid component | 2-50 |
| Surfactant | 1.0-20 |
| Acidulant | 5-15 |
| Dye | 0.0001-0.1 |
| Fragrance | 0.01-2.0 |

TABLE 6

| Exemplary Composition #6: Suitable Instrument Cleaning Composition | |
|---|---|
| Components | Approximate Range of Concentration (Wt %) |
| Solvent | 0-6 |
| Acid component | 0.1-10 |
| Surfactant | 0.01-2 |
| Filler | 45-55 |
| Water Conditioning Agent | 15-40 |
| Solidification Agent | 0-20 |

TABLE 7

| Exemplary Composition #7: Suitable Instrument Cleaning Composition | |
|---|---|
| Components | Approximate Range of Concentration (Wt %) |
| Solvent | 0-6 |
| Acid component | 0.1-10 |
| Filler | 55-65 |
| Water Conditioning Agent | 15-40 |
| Solidification Agent | 0-20 |

The acid component for the cleaning compositions described above is an alkane sulfonic acid, such as MSA, for example, either alone or in combination with other acidulants. Suitable acidulants include, but are not limited to, short- to medium-chain carboxylic acids, such as octanoic acid, for example. Suitable solvents for making the cleaning compositions of the invention include, but are not limited to, water and mixtures of water with other solvents. Suitable thickening agents include, but are not limited to, xanthan gum and modified xanthan gum. Suitable surfactants include, but are not limited to: anionic surfactants, nonionic surfactants, amphoteric surfactants and cationic surfactants and mixtures thereof. Suitable fillers include, for example, sodium sulfate. Suitable fillers and/or water conditioning agents include, for example, sodium gluconate. Exemplary suitable solidification agents include commercially available solidification agents such as polyethylene glycol 4000 or PEG4000.

Methods

The present invention relates to methods of cleaning objects using the cleaning compositions of the invention. The compositions include a short chain alkane sulfonic acid. In one embodiment, the compositions are substantially free of phosphoric acid. In an aspect, the cleaning compositions are used to remove soil and/or deposits from hard surfaces. The cleaning compositions are effective for removal of mineral and organic deposits, such as limescale and soap scum, for example, from hard surfaces without significant corrosive effect and without significant detrimental effect on the aesthetics of such surfaces.

Methods of using a cleaning composition on hard surfaces, including bathroom fixtures and dishwashing surfaces, are provided herein. In an aspect, a use composition of the cleaning composition can be used to clean hard surfaces without producing aesthetic defects. For example, the use composition is capable of cleaning bathroom fixtures coated using physical vapor deposition without producing aesthetic defects in the coating of the fixture.

The cleaning composition can be referred to as a detergent composition and can be provided in the form of a concentrated detergent composition or as a ready to use detergent composition. The concentrated detergent composition can be referred to as the concentrate, and can be diluted to provide the ready to use detergent composition or the use composition. The ready to use detergent composition can be referred to as the use composition when it is the composition that is intended to be used to clean a surface. In addition, the ready to use detergent composition can be further diluted to provide the use composition that is intended to be used to clean a surface. In the case of a cleaner for bathroom surfaces, fixtures and dishwashing surfaces, the ready to use composition can be the use composition and can be applied directly to a surface without further dilution. When cleaning certain hard surfaces, such as a counter, floor, or fixture, it may be desirable to dilute the ready to use composition (e.g., by placing a portion of the ready to use composition into a bucket of water) and clean the hard surface with the resulting use composition.

The cleaning composition can be provided as a concentrate for shipment to retail distributors, commercial end users, or non-commercial end users. The retail distributors or the commercial end users can dilute the concentrate to provide a less concentrated detergent composition or a ready to use detergent composition. The retail distributors can package and sell the less concentrated detergent composition or the ready to use detergent composition to consumers. In the case of a cleaner for bathroom surfaces, fixtures, and dishwashing surfaces, the retail distributor can dilute the concentrate to provide a cleaner in a ready to use form, and then package the glass cleaner for sale to consumers. Commercial end users, such as hotel custodial staff, commercial dishwashing facilities and the like, can dilute the concentrate to achieve a ready to use composition and then use the ready to use composition in their cleaning service. Non-commercial end users can purchase the concentrate and form the ready to use composition or can purchase the ready to use composition.

By providing the cleaning composition as a concentrate, the concentrate can be diluted with the water available at the locale or site of dilution. It is recognized that the level of water hardness can change from one locale to another. Accordingly, the concentrate can be formulated so that it can be diluted with water having varying amounts of hardness depending upon the locale or site of dilution while providing a desirable ready to use composition or use composition.

The cleaning composition can be prepared at a first location and shipped or transported to a second location for dilution. The second location can be provided with a water source that includes hardness. An suitable type of second location is a commercial store where the concentrate is diluted, packaged, and distributed to customers. The second location can be another facility that provides for further dilution and distribution of the product. In addition, the second location can be a job site, such as, a restaurant, grocery store, hotel, hospital or other building requiring janitorial services. In addition, it should be understood that there can be multiple locations where dilution occurs. For example, an intermediary dilution can occur at the second location, and the final dilution to a use solution can be provided by the consumer at about the time the detergent composition is used for cleaning.

The detergent composition concentrate can be prepared by mixing the components together. When an organic solvent is desired in the detergent composition concentrate, the components of the detergent composition concentrate, other than the organic solvent, can be combined together by mixing, and then the organic solvent can be added separately. In certain formulations, it is possible that the detergent composition concentrate containing the organic solvent may have a tendency to phase separate. A hydrotrope can be used to help reduce phase separation.

The detergent composition, when provided as a use solution, can be applied to a surface or substrate for cleaning in a variety of forms. Suitable forms include as a spray and as a foam. In the case of a glass cleaner, it may be desirable to provide the use solution as a foam in order to hinder running of the use solution down a vertical window. It is believed that a pump roamer can be used to create a foam for application to a surface or substrate without the need for propellants or other blowing agents. The foam can be characterized as a mechanically generated foam rather than a chemically generated foam when a hand or finger pump is used to create the foam. An suitable foaming head that can be used with the detergent composition can be obtained from commercially.

It is believed that the cleaning composition can be used as a hard surface cleaner, such as a bathroom cleaner, a metal cleaner (for use with bathroom fixtures or surgical instruments, for example), a cleaner for dishwashers, a cleaner for vehicles and the like. It should be understood that the cleaning composition can be applied directly to a surface such as a hard bathroom surface, a bathroom fixture, or the interior of a dishwasher, for example, and wiped away to provide a clean surface. In addition, the detergent composition can be rinsed from a surface with water.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from various commercial suppliers.

Soap Scum Removal from Hard Surfaces

Example 1

A composition of the present invention was prepared including 5.25% active methane sulfonic acid (MSA). The composition was diluted to 2 oz/gallon, 4 oz/gallon and 8 oz/gallon.

A comparative composition was prepared similarly to the composition above except that the comparative composition replaced the 5.25% active MSA with 17.64% active phosphoric acid. The comparative composition was also diluted to 2 oz/gallon, 4 oz/gallon and 8 oz/gallon.

To test the ability of the compositions to remove soap scum, ceramic tiles were soiled and baked in an oven. The ceramic tiles were then treated with each composition by scrubbing the tiles with a sponge. The ceramic tiles were machine scrubbed by the sponge with about 2 pounds of pressure. After scrubbing, the ceramic tiles were rinsed with cool tap water and allowed to air dry for at least about 30 minutes. The amount of soap scum removed was determined by measuring the change in percent reflectance of the ceramic tile after scrubbing. This procedure was repeated four times for each composition, with the average change in percent reflectance indicated below in Table 8.

The amount of soil removed was based on 60 degree gloss reflectance using the Gardner Micro-Tri-Gloss reflectance meter before and after testing. The higher the change in percent reflectance, the greater the ability of the composition to remove soap scum.

The dilution and change in percent reflectance of the composition and the comparative composition are shown in Table 8.

TABLE 8

| Dilution (oz/gallon) | Acid | Change in Percent Reflectance |
|---|---|---|
| 2 | 5.25% MSA | 65.5 |
| | 17.64% $H_3PO_4$ | 73 |
| 4 | 5.25% MSA | 81.8 |
| | 17.64% $H_3PO_4$ | 50.4 |
| 8 | 5.25% MSA | 94.2 |
| | 17.64% $H_3PO_4$ | 95.1 |

The results in Table 8 demonstrate that the composition including methane sulfonic acid exhibited either similar or superior soap scum removal ability when compared to the comparative composition.

As shown in Table 8, the composition including MSA exhibited similar soap scum removal properties as the comparative composition including $H_3PO_4$ at 2 oz/gallon and 8 oz/gallon dilutions. At an 6 oz/gallon dilution, the composition including MSA showed an increasingly superior soap scum removal profile compared to the composition including $H_3PO_4$. In particular, the ceramic tiles treated with the composition including 5.25% active MSA resulted in about a 38.39% greater change in percent reflectance than the ceramic tiles treated with the composition including 17.64% active $H_3PO_4$.

Because the composition including MSA included only 5.25% active acid and the composition including phosphoric acid included 17.64% active acid, the composition including MSA is about 3 times as effective as the composition including phosphoric acid at removing soap scum.

Example 2

The soap scum removal capabilities of cleaning compositions containing methane sulfonic acid (MSA) were then compared with the soap scum removal capabilities of various inorganic acid compositions, including phosphoric acid and urea hydrochloride. To compare the efficiency of the various cleaning compositions on soap scum, 8 oz/gallon solutions of various compositions were prepared containing one of MSA, phosphoric acid and urea hydrochloride.

A first set of compositions (Composition A) and a second set of compositions (Composition B) were prepared. The compositions of Composition A included the test acid and citric acid. The compositions of Composition B included the test acid, citric acid and octanoic acid. The only difference among the compositions of Composition A was the test acid and the only difference among the compositions of Composition B was the test acid. In addition, water was also used as a comparative example.

Ceramic tiles soiled and baked in an oven were treated with each composition by scrubbing the tiles with a sponge. The ceramic tiles were machine scrubbed by the sponge with about 2 pounds of pressure. After scrubbing, the ceramic tiles were rinsed with cool tap water and allowed to air dry for at least about 30 minutes. The amount of soap scum removed was determined by measuring the change in percent reflectance of the ceramic tiles after scrubbing.

The amount of soil removed was based on 60 degree gloss reflectance using the Gardner Micro-Tri-Gloss reflectance meter before and after testing. The higher the change in percent reflectance, the greater the ability of the composition to remove soap scum.

The acid and change in percent reflectance are listed in Table 9 for each of the compositions tested.

TABLE 9

| | Acid | Change in Percent Reflectance |
|---|---|---|
| Composition A | 5.6% active MSA | 63.8 |
| | 17.44% active Phosphoric acid | 67.6 |
| | 5.6% active Urea hydrochloride | 58.7 |
| Composition B | 6.48% active MSA | 72.6 |
| | 20.5% active Phosphoric acid | 71.8 |
| | 6.48% active Urea hydrochloride | 63.4 |
| Water | | 8.4 |

As can be seen from the data in Table 9, the compositions containing MSA performed similarly to or outperformed the compositions including phosphoric acid and urea hydrochloride for both Composition A and Composition B. All of the acidic formulas also substantially outperformed the composition including only water.

For Composition A, the composition including 5.6% active MSA outperformed the composition including the same active amount of urea hydrochloride and performed substantially similarly to the composition including almost 3 times the amount of active phosphoric acid. In particular, the composition including 5.6% active MSA had about an 8% greater change in reflectance than the composition including 5.6% active urea hydrochloride while the composition including 17.44% active phosphoric acid only had about a 5.77% greater change in reflectance than the composition including 5.6% active MSA.

For Composition B, the composition containing 6.48% active MSA outperformed the compositions containing both phosphoric acid and urea hydrochloride at removing soap scum. In particular, the composition including 6.48% active MSA had a slightly higher percent reflectance than the composition that included 17.44% active phosphoric acid, or about three times as much acid. The composition including 6.48% active MSA also had about a 12.67% higher percent reflectance than the composition which included the same amount of active urea hydrochloride as active MSA.

It was discovered that the MSA-containing compositions were surprisingly more effective against soap scum than the other acid compositions.

Example 3

The soap scum removal capabilities of cleaning compositions containing methane sulfonic acid were then compared with the soap scum removal capabilities of cleaning compositions containing various other acid compositions, including organic acids.

To compare the effectiveness of various cleaning compositions at removing soap scum, 10% active solutions of MSA-containing compositions were prepared. 10% active solutions of various inorganic and organic acids were also prepared.

Marble blocks covered with soap scum were first weighed and then exposed to the various compositions for either 5 minutes or 10 minutes as noted below in Table 10. After the appropriate amount of time, the marble blocks were reweighed. The effectiveness of each composition at removing soap scum was determined by the change in weight of the tile after exposure to each composition. The change in weight represents the amount of calcium carbonate dissolved by the acid compositions, which is considered equivalent to the amount of soap scum removed from the surface.

The percent change in weight of each marble block exposed to the different acid compositions is shown in Table 10.

TABLE 10

| Acid | Initial weight (g) | Duration (min) | Subsequent weight (g) | Change in weight (g) | % Change |
|---|---|---|---|---|---|
| MSA | 63.59 | 10 | 60.01 | 3.58 | 5.6 |
| $H_3PO_4$ | 64.36 | 10 | 62.80 | 1.56 | 2.4 |
| MSA | 63.98 | 5 | 61.44 | 2.54 | 4.0 |
| MSA | 64.24 | 5 | 61.54 | 2.70 | 4.2 |
| $H_3PO_4$ | 65.21 | 5 | 64.60 | 0.61 | 0.9 |
| $H_3PO_4$ | 61.87 | 5 | 60.80 | 1.07 | 1.7 |
| Lactic acid | 65.06 | 5 | 64.92 | 0.14 | 0.2 |
| Citric acid | 63.88 | 5 | 63.79 | 0.09 | 0.1 |
| Maleic acid | 65.81 | 5 | 65.02 | 0.79 | 1.2 |
| Sulfamic acid | 64.50 | 5 | 62.69 | 1.81 | 2.8 |
| Dicarboxylic Acid Blend | 64.96 | 5 | 65.01 | −0.05 | −0.1 |

The results in Table 10 demonstrate that compositions including methane sulfonic acid have better soap scum removal ability than other acids, including phosphoric acid and organic acids. In particular, the compositions containing MSA outperformed the compositions containing phosphoric acid in removing soap scum. After a 10 minute exposure to the acid solutions, the composition including MSA had about a 3.2% greater change in weight than the composition including phosphoric acid. After a 5 minute exposure to the acid solutions, the MSA compositions had about a 4.1% change in weight on average while the phosphoric acid compositions had about a 1.3% change in weight on average.

As can be seen in Table 10, the organic acids such as lactic acid and citric acid were less effective against soap scum, having only a 0.2% and 0.1% change in weight, respectively.

While the composition containing sulfamic acid did not remove as much soap scum as the compositions including MSA, sulfamic acid did remove some soap scum and had some ability to penetrate the soap scum layer. This suggests that the sulfonic acid functionality is key to penetrating the soap scum layer.

It was discovered that the MSA-containing compositions were surprisingly more effective at removing soap scum than the other acid compositions.

Limescale Removal from Hard Surfaces

Example 4

The limescale removal capabilities of cleaning compositions containing methane sulfonic acid (MSA) were compared with the limescale removal capabilities of cleaning compositions containing phosphoric acid.

Compositions of the present invention including 5.5% active MSA and 7.6% active MSA were prepared.

For comparison, two comparative compositions were prepared similarly to the compositions above except that the MSA was replaced with phosphoric acid. One of the comparative compositions included 22.5% phosphoric acid and the other comparative composition included 30% phosphoric acid.

Marble blocks representing limescale were first cleaned with warm water and allowed to dry. After drying, the marble blocks were weighed. The marble blocks were then submersed in the compositions for about 10 minutes. After the 10 minutes, the blocks were rinsed, dried and reweighed. The effectiveness of each composition at removing limescale was measured by the change in weight of the block after exposure to each composition. The change in weight represents the amount of calcium carbonate dissolved by the acid compositions, which is considered equivalent to the amount of limescale removed from the surface.

The average percent change in weight of the marble blocks exposed to the different acidic cleaning compositions containing surfactants are shown in Table 11.

TABLE 11

| Acid | Initial weight (g) | Subsequent weight (g) | Change in weight (g) | Percent Change (%) |
|---|---|---|---|---|
| 5.5% MSA | 63.43 | 61.49 | 1.94 | 3.1 |
| 7.6% MSA | 64.10 | 61.27 | 2.83 | 4.4 |
| 22.5% $H_3PO_4$ | 61.44 | 59.57 | 1.87 | 3.0 |
| 30% $H_3PO_4$ | 65.78 | 63.46 | 2.32 | 3.5 |

As can be seen from the data in Table 11, the compositions containing MSA outperformed the compositions containing phosphoric acid at removing limescale. The results in Table 9 demonstrate that compositions including methane sulfonic acid showed similar or improved limescale removal capacity at various activities compared to a commercially used limescale removing component, phosphoric acid. In particular, the composition including 5.5% active MSA had a limescale removal ability comparable to the composition including 22.5% active $H_3PO_4$ and the composition including 30% active $H_3PO_4$. However, at 4.4% activity, the composition including MSA showed a substantially greater ability to remove limescale than the $H_3PO_4$-containing compositions at both 22.5% and 30% activities, having at least a 20% greater percent change in weight.

It was discovered that the MSA-containing compositions were surprisingly more effective against limescale than the phosphoric acid-containing compositions at similar dilution levels.

Example 5

The limescale removal capabilities of cleaning compositions containing various dilutions of methane sulfonic acid were compared with the limescale removal capabilities of cleaning compositions containing various other acid compositions at the same dilutions, including organic acids.

To compare the effectiveness of various cleaning compositions at removing limescale, 1.5%, 3.5% and 7.5% active MSA compositions were prepared.

Solutions including sulfamic acid, maleic acid, citric acid, phosphoric acid, lactic acid and a dicarboxylic acid blend were also prepared. Each of the compositions included 1.5%, 3.5% and 7.5% active acid samples.

Marble blocks were cleaned with warm water, dried by heating and then cooled to room temperature. The blocks were weighed and immersed in the various test solutions for about 15 minutes. The marble blocks were then rinsed, dried, cooled and reweighed. The effectiveness of each composition to remove limescale was determined by the change in weight of the marble block after exposure to each composition.

The average weight dissolved from each marble block (which corresponds to the amount of limescale removal) by the different acid compositions is shown in Tables 12-14.

TABLE 12

| Acid (1.5%) | Ave. weight dissolved ($g/cm^2/hr$) |
|---|---|
| MSA | 0.0351 |
| Sulfamic Acid | 0.0316 |
| Maleic Acid | 0.0270 |
| Citric Acid | 0.0124 |
| Phosphoric Acid | 0.0235 |
| Lactic Acid | 0.0146 |
| Dicarboxylic Acid Blend | 0.0088 |

TABLE 13

| Acid (3.5%) | Ave. weight dissolved ($g/cm^2/hr$) |
|---|---|
| MSA | 0.0941 |
| Sulfamic Acid | 0.0953 |
| Maleic Acid | 0.0649 |
| Citric Acid | 0.0393 |
| Phosphoric Acid | 0.0881 |
| Lactic Acid | 0.0671 |
| Dicarboxylic Acid Blend | 0.0290 |

TABLE 14

| Acid (7.5%) | Ave. weight dissolved ($g/cm^2/hr$) |
|---|---|
| MSA | 0.1986 |
| Sulfamic Acid | 0.1988 |
| Maleic Acid | 0.1348 |
| Citric Acid | 0.0640 |
| Phosphoric Acid | 0.1664 |
| Lactic Acid | 0.1202 |
| Dicarboxylic Acid Blend | 0.0448 |

The results in Tables 12-14 demonstrate that compositions including methane sulfonic acid have either comparable or greater limescale removal ability than other acids, including phosphoric acid and organic acids. As can be seen from the data in Tables 12-14, the compositions containing MSA performed similarly to the compositions containing sulfamic acid at all activity levels and outperformed the compositions containing organic acids at all activity levels.

The data above indicates that sulfamic acid is effective in dissolving limescale, suggesting that an acid having a sulfonic acid group performs most effectively against limescale.

The compositions including MSA showed a superior limescale removal profile compared to the compositions including $H_3PO_4$, a known component having limescale removing properties. This was particularly observable at lower acid activity levels. At a 1.5% activity level, the MSA composition removed about 33% more limescale than the phosphoric acid composition at the same activity level.

The maleic acid, citric acid, lactic acid and dicarboxylic acid blend were significantly less effective against limescale than the MSA. This was observable at all acid activity levels. The MSA-containing compositions outperformed maleic acid by at least about 23%, citric acid by at least about 58%, lactic acid by at least about 29% and the dicarboxylic acid blend by at least about 70% at corresponding acid activity levels.

It was discovered that the MSA-containing compositions were surprisingly more effective at removing limescale than the other acid compositions.

Calcium Carbonate Removal

Example 6

The ability of cleaning compositions containing methane sulfonic acid (MSA) and cleaning compositions containing other acids at removing calcium carbonate (mineral deposit) were tested. A first composition was prepared using Exemplary Solution #1 shown in Table 1, a second composition was prepared using Exemplary Solution #2 shown in Table 2 and a third composition was prepared using Exemplary Solution #3 shown in Table 3. Exemplary Solution #1 included 12.2% active MSA, Exemplary Solution #2 included 7.56% active MSA and Exemplary Solution #3 included 7.7% active MSA.

Comparative compositions were prepared similarly to the compositions above except that the comparative compositions replaced the MSA with phosphoric acid. Exemplary Solution #1 included 36% active phosphoric acid, Exemplary Solution #2 included 30% active phosphoric acid and Exemplary Solution #3 included 27.5% active phosphoric acid. The first and third comparative compositions of Exemplary Solutions #1 and #3 also replaced the MSA with citric acid. The composition of Exemplary Solution #1 also included 5% active citric acid and the composition of Exemplary Solution #3 also included 6.5% active citric acid.

Marble blocks were cleaned with warm water, dried by heating and then cooled to room temperature. The blocks were weighed and immersed in the various test solutions for about 15 minutes. The blocks were then rinsed, dried, cooled and reweighed. The effectiveness of each composition to remove calcium carbonate was determined by the change in weight of the tile after exposure to each composition.

The average weight dissolved from each marble block exposed to the compositions is shown in Tables 15-17.

TABLE 15

(Exemplary Solution #1).

| Acid | Trial # | Initial Wt. (g) | Weight after 15 min soak (g) | Weight removed (g) | Ave. weight removed | % Removal | Ave. % removal |
|---|---|---|---|---|---|---|---|
| MSA | #1 | 64.08 | 60.63 | 3.45 | 3.57 | 5.38 | 5.55 |
| | #2 | 65.46 | 61.98 | 3.48 | | 5.32 | |
| | #3 | 65.36 | 61.88 | 3.48 | | 5.32 | |
| | #4 | 63.75 | 60.01 | 3.73 | | 5.85 | |
| | #5 | 63.00 | 59.29 | 3.70 | | 5.88 | |
| Phosphoric | #1 | 65.51 | 62.33 | 3.18 | 3.31 | 4.85 | 5.13 |
| Acid + | #2 | 65.52 | 62.20 | 3.32 | | 5.07 | |
| Citric | #3 | 62.68 | 59.20 | 3.48 | | 5.55 | |
| Acid | #4 | 65.42 | 62.18 | 3.24 | | 4.95 | |
| | #5 | 64.06 | 60.71 | 3.35 | | 5.23 | |

TABLE 16

(Exemplary Solution #2).

| | Trial # | Initial Wt. (g) | Wt. after 15 min soak (g) | Weight removed (g) | Ave. weight removed | % Removal | Ave. % removal |
|---|---|---|---|---|---|---|---|
| MSA | #1 | 60.61 | 57.25 | 3.36 | 3.01 | 5.54 | 4.80 |
| | #2 | 59.57 | 56.09 | 3.48 | | 5.84 | |
| | #3 | 66.36 | 63.55 | 2.80 | | 4.22 | |
| | #4 | 66.14 | 63.49 | 2.64 | | 3.99 | |
| | #5 | 62.62 | 59.87 | 2.75 | | 4.39 | |
| Phosphoric | #1 | 63.25 | 60.21 | 3.04 | 3.15 | 4.81 | 4.93 |
| Acid + | #2 | 61.74 | 58.59 | 3.15 | | 5.10 | |
| Citric | #3 | 63.82 | 60.57 | 3.26 | | 5.11 | |
| Acid | #4 | 65.40 | 62.21 | 3.19 | | 4.88 | |
| | #5 | 65.58 | 62.46 | 3.12 | | 4.76 | |

TABLE 17

(Exemplary Solution #3).

| | Trial # | Initial weight (g) | Weight after 15 min soak (g) | Grams removed | Ave. weight removed | % Removal | Ave. % removal |
|---|---|---|---|---|---|---|---|
| MSA | #1 | 64.26 | 63.01 | 1.25 | 1.15 | 1.94 | 1.41 |
| | #2 | 65.04 | 63.64 | 1.39 | | 2.14 | |
| | #3 | 62.14 | 59.76 | 2.38 | | 0 | |
| | #4 | 65.12 | 64.19 | 0.93 | | 1.43 | |
| Phosphoric Acid | #1 | 62.72 | 61.70 | 1.02 | 0.69 | 1.63 | 0.87 |
| | | 62.18 | 61.46 | 0.72 | | 1.16 | |
| | #2 | 65.13 | 64.62 | 0.51 | | 0 | |
| | #3 | 64.62 | 64.15 | 0.47 | | 0.73 | |
| | #4 | 66.13 | 65.59 | 0.54 | | 0.82 | |

As can be seen from the data in Tables 15-17, the compositions containing MSA had similar calcium carbonate removal ability when compared to the calcium carbonate removal ability of the comparative compositions containing a greater percent activity of phosphoric acid. The MSA-containing compositions showed a slightly enhanced calcium carbonate removal profile $H_3PO_4$ containing composition, particularly in the cases of Exemplary solutions #1 and #3. The solutions of Exemplary solutions #1 and #3 contained a greater amount of thickening agent and were therefore more viscous and better retained on the marble block surface during immersion.

It was discovered that the MSA-containing compositions were surprisingly more effective against limescale than the phosphonic acid-containing compositions.

Corrosion Propensity

Example 7

To test the corrosion propensity of various types of surfaces to various acids, corresponding solutions were prepared and tested. The surfaces tested included physical vapor deposition (PVD) metal substrates, metal alloy substrates and plated metal substrates. The PVD surfaces tested included AF-French Gold, BN-Brushed Nickel, BV-Brushed Bronze, BX-Brazen Bronze, VS-Brushed Stainless Steel, SN-Polished Nickel and VF-Polished Brass. The metal alloy surfaces tested included Copper Alloy 110, Brass Alloy 353, Aluminum Alloy 6061, Galvanized Metal CRS and Stainless Steel 304. The plated metal surfaces tested included CP-Polished Chrome Plated and G-Brushed Chrome Plated.

A composition of the present invention included 5% active MSA. The acid dilution was made with lab de-ionized (DI) water.

Comparative compositions contained various other acids including $H_3PO_4$, HCl, $H_2SO_4$, $HNO_3$, $H_3NSO_3$, lactic acid, citric acid or gluconic acid. The acids were diluted with DI water to 5% activity.

The surfaces were spot tested with each of the compositions and left uncovered. One drop of each acid composition was placed on the surfaces for about 15 minutes and allowed to air dry. After the application time, the surfaces were rinsed with DI water and wiped dry with a paper towel. If there were any changes, a standard liquid detergent was applied onto the surface which was then cleaned with a paper towel, rinsed and dried.

Corrosion of the surfaces was rated on a scale of 0 to 2. 0 indicates that the surface was unaffected, 1 indicates that there was a slight pitting and/or mild corrosion to the surface, and 2 indicates that there was pitting and corrosion. A "B" indicates that bubbles formed on the surface.

Table 18 lists the corrosion ratings of each of the compositions on each of the tested surfaces.

TABLE 18

| | MSA | $H_3PO_4$ | HCl | $H_2SO_4$ | $HNO_3$ | $H_3NSO_3$ | Lactic acid | Citric acid | Gluconic acid |
|---|---|---|---|---|---|---|---|---|---|
| Copper Alloy | 0 | 0 | 0 | 0 | 0 | 0 | 0 | 0 | 0 |
| Brass Alloy | 0 | 0 | 0 | 0 | 0 | 0 | 0 | 0 | 0 |
| Aluminum Alloy | 0, B | 1, B | 2, B | 0, B | 0 | 0, B | 0 | 0 | 0 |
| Stainless Steel Alloy | 0 | 0 | 0 | 0 | 0 | 0 | 0 | 0 | 0 |
| Galvanized Metal CRS | 0, B | 0, B | 2, B | 2, B | 2, B | 0, B | 0 | 0 | 0 |
| AF-French Gold | 0 | 0 | 0 | 0 | 1, B | 0 | 0, B | 0, B | 0, B |
| BN-Brushed Nickel | 0 | 0 | 0 | 0 | 0 | 0 | 0 | 0 | 0 |
| BV-Brushed Bronze | 0 | 0 | 0 | 0 | 1, B | 0 | 0 | 0 | 0 |
| BX-Brazen Bronze | 0 | 0 | 0 | 0 | 0, B | 0 | 0 | 0 | 0 |
| SN-Polished Nickel | 0 | 0 | 0 | 0 | 1, B | 0 | 0 | 0 | 0 |
| VF-Polished Brass | 0 | 0 | 0 | 0 | 1, B | 0 | 0 | 0 | 0 |
| VS-Brushed Stainless Steel | 0 | 0 | 0 | 0 | 0 | 0 | 0 | 0 | 0 |
| CP-Polished Chrome Plated | 0 | 0 | 0 | 0 | 1, B | 0 | 0 | 0 | 0 |
| G-Brushed Chrome Plated | 0 | 0 | 0 | 0 | 0 | 0 | 0 | 0 | 0 |

The data in Table 18 illustrates that MSA, at 5% activity, did not have detrimental effects on the various PVD metal substrates or the plated metal alloys. Similarly, $H_3PO_4$, $H_3NSO_3$, lactic acid, citric acid and gluconic acid generally did not cause permanent changes in the surfaces. While there was some bubbling, the bubbling did not indicate a detrimental effect to the surface.

By contrast, the HCl, $H_2SO_4$, and $HNO_3$ did cause some permanent corrosion on the tested surfaces. In particular, the HCl caused pitting and corrosion to the aluminum steel and each of HCl, $H_2SO_4$, and $HNO_3$ caused pitting and corrosion on the galvanized metal.

It was discovered that the MSA-containing compositions were surprisingly less likely to cause pitting or corrosion on surfaces than HCl, $H_2SO_4$, or $HNO_3$-containing compositions.

Example 8

To test the corrosion propensity of various types of surfaces to various acids, corresponding solutions were prepared and tested. The surfaces tested included physical vapor deposition (PVD) metal substrates, metal alloy substrates and plated metal substrates. The PVD surfaces tested included AF-French Gold, BN-Brushed Nickel, BV-Brushed Bronze, BX-Brazen Bronze, VS-Brushed Stainless Steel, SN-Polished Nickel and VF-Polished Brass. The metal alloy surfaces tested included Copper Alloy 110, Brass Alloy 353, Aluminum Alloy 6061, Galvanized Metal CRS and Stainless Steel 304. The plated metal surfaces tested included CP-Polished Chrome Plated and G-Brushed Chrome Plated.

A composition of the present invention included 10% active MSA. The acid dilution was made with lab de-ionized (DI) water.

Comparative compositions were also prepared including various other acids. In particular, the compositions included $H_3PO_4$, $HNO_3$, $H_3NSO_3$, or lactic acid. The acids were diluted with DI water to 10% activity.

The surfaces were spot tested with each of the solutions and left uncovered. One drop of the acid solution was placed on the surfaces for about one hour and allowed to air dry. After the appropriate application time, the surfaces were rinsed with DI water and wiped dry with a paper towel. If there were any changes, a standard liquid detergent was applied onto the surface which was then cleaned with a paper towel, rinsed and dried.

Corrosion of the surfaces was rated on a scale of 0 to 2. 0 indicates that the surface was unaffected, 1 indicates that there was a slight pitting and/or mild corrosion to the surface, and 2 indicates that there was pitting and corrosion. A "B" indicates that bubbles formed on the surface and a "G" indicates that the solution turned green.

Table 19 lists the corrosion ratings of each of the compositions on each of the tested surfaces.

TABLE 19

| | MSA | $H_3PO_4$ | $HNO_3$ | $H_3NSO_3$ | Lactic acid |
|---|---|---|---|---|---|
| AF-French Gold | 0, B | 0, B | 1, G, B | 0, B | 0, B |
| BN-Brushed Nickel | 0, B | 0, B | 2, G, B | 0, B | 0, B |
| BV-Brushed Bronze | 0, B | 0, B | 2, G, B | 0, B | 0, B |
| BX-Brazen Bronze | 0, B | 0 | 2, G, B | 0, B | 0, B |
| SN-Polished Nickel | 0, B | 0, B | 2, G, B | 0, B | 0, B |
| VF-Polished Brass | 0, B | 0, B | 2, G, B | 0, B | 0, B |
| VS-Brushed Stainless Steel | 0, B | 0, B | 2, G, B | 0, B | 0, B |

TABLE 19-continued

| | MSA | $H_3PO_4$ | $HNO_3$ | $H_3NSO_3$ | Lactic acid |
|---|---|---|---|---|---|
| CP-Polished Chrome Plated | 0, B | 0, B | 1, G, B | 0, B | 0, B |
| G-Brushed Chrome Plated | 0, B | 0 | 2, G, B | 0, B | 0, B |
| Copper Alloy | 0 | 0 | 2, B | 0 | 0 |
| Brass Alloy | 0 | 0 | 0 | 0 | 0 |
| Aluminum Alloy | 0, B | 1, B | 0, B | 0, B | 0, B |
| Stainless Steel Alloy | 0 | 0 | 0, B | 0 | 0 |
| Galvanized Metal CRS | 0, B | 0, B | 2, G, B | 0, B | 0, B |

The data in Table 19 illustrates that MSA, at 10% activity, did not have detrimental effects on the various PVD metal substrates or the plated metal alloys. Similarly, $H_3PO_4$, $H_3NSO_3$ and lactic acid also did not cause permanent changes on the surfaces. While there was some bubbling, the bubbling did not indicate a detrimental effect to the surface.

By contrast, the $HNO_3$ did cause some corrosion on the tested surfaces. In particular, the $HNO_3$ caused pitting and corrosion to nearly all of the PVD surfaces, as well as the copper alloy. While there was some slight pitting and/or mild corrosion to the PVD french gold surface and plated polished chrome surface, the amount of changes were minimal and still considered acceptable.

It was discovered that the MSA-containing compositions were surprisingly less likely to cause pitting or corrosion of PVD surfaces than $HNO_3$.

Example 9

To test the corrosion propensity of various types of surfaces to various acids, corresponding solutions were prepared and tested. The surfaces tested included physical vapor deposition (PVD) metal substrates, metal alloy substrates and plated metal substrates The PVD surfaces tested included AF-French Gold, BN-Brushed Nickel, BV-Brushed Bronze, BX-Brazen Bronze, VS-Brushed Stainless Steel, SN-Polished Nickel and VF-Polished Brass. The metal alloy surfaces tested included Copper Alloy 110, Brass Alloy 353, Aluminum Alloy 6061, Galvanized Metal CRS and Stainless Steel 304. The plated metal surfaces tested included CP-Polished Chrome Plated and G-Brushed Chrome Plated.

A composition of the present invention included 5% active MSA. The acid dilution was made with lab de-ionized (DI) water.

Comparative compositions were also prepared containing various other acids including $H_3PO_4$, HCl, $H_2SO_4$, $HNO_3$, $H_3NSO_3$, lactic acid, citric acid, urea HCL or de-ionized water. The acids were diluted with DI water to 5% activity The surfaces were spot tested with each of the solutions and left uncovered. One drop of the acid solution was placed on the surfaces for about 24 hours and allowed to air dry. After the application time, the surfaces were rinsed with DI water and wiped dry with a paper towel. If there were any changes, a standard liquid detergent was applied onto the surface which was then cleaned with a paper towel, rinsed, and dried. The surfaces were rated based on a standard rating and a severity rating.

The standard rating was based on a scale of 0 to 2. 0 indicates that the surface was unaffected, 1 indicates that there was a temporary change in the surface but the change was removed by water and detergent, and 2 indicates that there was a permanent change in the surface that could not be removed by water and detergent. The severity rating was based on a scale of 0 to 3. 0 indicates that the surface was unaffected, 1 indicates that the surface was slightly affected, 2 indicates that the surface was moderately affected, and 3 indicates that the surface was severely affected.

Table 20 lists the standard and severity ratings of each of the compositions on each of the tested surfaces.

TABLE 20

| | Rating | MSA | $H_3PO_4$ | HCl | $H_2SO_4$ | $HNO_3$ | $H_3NSO_3$ | Lactic acid | Citric acid | Urea HCl | DI Water |
|---|---|---|---|---|---|---|---|---|---|---|---|
| AF-French | Standard | 0 | 0 | 0 | 0 | 0 | 0 | 0 | 0 | 0 | 0 |
| Gold | Severity | 0 | 0 | 0 | 0 | 0 | 0 | 0 | 0 | 0 | 0 |
| BN- | Standard | 0 | 2 | 2 | 0 | 2 | 0 | 0 | 0 | 0 | 0 |
| Brushed | Severity | 0 | 2 | 3 | 0 | 3 | 0 | 0 | 0 | 0 | 0 |
| Nickel | | | | | | | | | | | |
| BV- | Standard | 0 | 0 | 2 | 1 | 1 | 0 | 0 | 0 | 2 | 0 |
| Brushed | Severity | 0 | 0 | 2 | 1 | 1 | 0 | 0 | 0 | 3 | 0 |
| Bronze | | | | | | | | | | | |
| BX-Brazen | Standard | 0 | 2 | 2 | 2 | 2 | 0 | 0 | 0 | 0 | 2 |
| Bronze | Severity | 0 | 1 | 3 | 1 | 3 | 0 | 0 | 0 | 0 | 1 |
| VS- | Standard | 0 | 0 | 2 | 2 | 2 | 0 | 0 | 0 | 2 | 0 |
| Brushed | Severity | 0 | 0 | 3 | 2 | 2 | 0 | 0 | 0 | 2 | 0 |
| Stainless | | | | | | | | | | | |
| Steel | | | | | | | | | | | |
| SN- | Standard | 0 | 2 | 1 | 0 | 0 | 0 | 0 | 0 | 0 | 0 |
| Polished | Severity | 0 | 2 | 1 | 0 | 0 | 0 | 0 | 0 | 0 | 0 |
| Nickel | | | | | | | | | | | |
| VF- | Standard | 0 | 2 | 2 | 2 | 0 | 0 | 0 | 0 | 0 | 0 |
| Polished | Severity | 0 | 3 | 1 | 3 | 0 | 0 | 0 | 0 | 0 | 0 |
| Brass | | | | | | | | | | | |
| Copper | Standard | 2 | 2 | 2 | 2 | 2 | 2 | 2 | 2 | 2 | 0 |
| Alloy | Severity | 2 | 2 | 3 | 2 | 3 | 2 | 1 | 1 | 2 | 0 |
| Brass | Standard | 2 | 2 | 2 | 2 | 2 | 2 | 2 | 2 | 2 | 0 |
| Alloy | Severity | 2 | 1 | 3 | 3 | 3 | 1 | 1 | 1 | 2 | 0 |
| Aluminum | Standard | 2 | 2 | 2 | 2 | 2 | 2 | 1 | 1 | 2 | 1 |
| Alloy | Severity | 2 | 2 | 3 | 2 | 2 | 1 | 0 | 0 | 2 | 0 |
| Galvanized | Standard | 2 | 2 | 2 | 2 | 2 | 2 | 2 | 2 | 2 | 0 |
| Metal CRS | Severity | 1 | 3 | 1 | 1 | 2 | 1 | 1 | 1 | 1 | 0 |
| Stainless | Standard | 2 | 1 | 2 | 2 | 1 | 1 | 0 | 0 | 2 | 0 |
| Steel Alloy | Severity | 2 | 0 | 3 | 3 | 0 | 0 | 0 | 0 | 2 | 0 |
| CP- | Standard | 0 | 0 | 2 | 0 | 2 | 0 | 0 | 0 | 2 | 0 |
| Polished | Severity | 0 | 0 | 2 | 0 | 1 | 0 | 0 | 0 | 1 | 0 |
| Chrome | | | | | | | | | | | |
| Plated | | | | | | | | | | | |
| G-Brushed | Standard | 0 | 0 | 2 | 0 | 0 | 0 | 0 | 0 | 2 | 0 |
| Chrome | Severity | 0 | 0 | 3 | 0 | 0 | 0 | 0 | 0 | 3 | 0 |
| Plated | | | | | | | | | | | |

The data in Table 20 illustrates that at 5% activity, MSA did not have detrimental effects on the various PVD metal substrates or the plated metal alloys. However, the MSA did affect the surfaces of metal alloys. The composition including the MSA behaved similarly to the compositions including $H_3NSO_3$, lactic acid and citric acid, which also did not have a detrimental effect on the PVD metal substrates or the plated metal alloys, but did cause some changes on the metal alloys, generally causing permanent changes to the surfaces.

By comparison, the compositions including $H_3PO_4$, HCl, $H_2SO_4$, $HNO_3$ and urea HCl all had detrimental effects on nearly all of the surfaces tested. While some of the changes were reversible using detergent and water, most of the changes resulted in moderate to severe corrosion of the substrates.

As was expected, the composition which included deionized water did not have any permanent detrimental effects on any of the surfaces other than brazen bronze. Any other effect the deionized water had on any of the substrates was treatable with detergent and water.

It was discovered that the MSA-containing compositions surprisingly had no visual corrosive effect on PVD surfaces and plated metal alloy surfaces compared to the other acid-containing compositions.

Example 10

To test the corrosion propensity of MSA, phosphoric acid and hydrochloric acid on various surfaces, corresponding solutions were prepared and tested.

Compositions of the present invention were prepared including either 5% active or 10% active MSA, as indicated below in Table 21.

For comparison, a plurality of comparative compositions were similarly prepared except that the compositions replaced the MSA with either 5% or 10% active phosphoric acid or 5% active hydrochloric acid, as indicated below in Table 21.

A plurality of coupons formed from copper, brass, aluminum, stainless steel, or PVD brazen bronze were used. A few drops of each solution were dropped onto each coupon for about 15 minutes. The solutions were recaptured and analyzed by spectroscopy to test for the presence of metals. In particular, the presence of aluminum, iron, copper and zinc (in parts per billion) were noted. This procedure was repeated twice with the average noted in Table 21.

Table 21 lists the acid, the activity level of the acid and the amount of aluminum, iron, copper and zinc in the recaptured solutions for each of the compositions.

TABLE 21

| Coupon | Acid | Aluminum (ppb) | Iron (ppb) | Copper (ppb) | Zinc (ppb) |
|---|---|---|---|---|---|
| Copper | 5% MSA | — | 145 | 1900 | 185 |
| | 5% $H_3PO_4$ | 15 | 185 | 2200 | 465 |
| | 5% HCl | 22 | 135 | 4900 | 550 |
| Brass | 5% MSA | — | 93.5 | 6.9 ppm | 8.35 |
| | 5% $H_3PO_4$ | 25 | 190 | 7150 | 8800 |
| | 5% HCl | 24 | 115 | 12 ppm | 12 ppm |
| Aluminum 6061 | 5% MSA | 670 | 56.5 | 13 | 63.5 |
| | 5% $H_3PO_4$ | 9550 | 305 | 702 | 185 |
| | 5% HCl | 453 | 4600 | 1495 | 320 |
| Stainless Steel | 5% MSA | — | 360 | 14.5 | 37 |
| | 5% $H_3PO_4$ | 12 | 460 | 6.6 | 109.5 |
| | 5% HCl | 17.5 | 7800 | 10.45 | 40 |
| Aluminum 1010 | 5% MSA | 475 | 175 | <1 | 280 ppm |
| | 5% $H_3PO_4$ | 900 | 610 | 38 | 935 ppm |
| | 5% HCl | 8550 | 30 ppm | 275 | 5550 ppm |
| Brazen Bronze (PVD) | 5% MSA | <40 | <40 | 535 | 140 |
| | 10% MSA | <40 | <40 | 335 | 210 |
| | 5% $H_3PO_4$ | <40 | 140 | 155 | 345 |
| | 10% $H_3PO_4$ | <40 | 130 | 350 | 305 |

As illustrated in Table 21, the propensity of 5% active MSA to corrode copper, brass, stainless steel, aluminum was substantially less than the propensity of 5% active phosphoric acid and 5% active hydrochloric acid to corrode the same surfaces. In particular, the recaptured MSA composition contained about 60% less zinc than the recaptured phosphoric acid composition and about 66% less zinc than the recaptured hydrochloric acid composition. In evaluating brass, the recaptured MSA composition contained about 99.9% less zinc than the recaptured phosphoric acid composition. A substantial difference was also observed when comparing the propensity of MSA and the propensity of phosphoric acid and hydrochloric acid to corrode aluminum 6061 and aluminum 1010.

The propensity of MSA to corrode PVD brazen bronze surface was also substantially less than the propensity of phosphoric acid to corrode the PVD surface at 5% activity and 10% activity. At 5% activity, the recaptured MSA composition contained about 71% less iron and about 59% less zinc than the recaptured phosphoric acid composition. At 10% activity, the recaptured MSA composition contained about 69% less iron and about 31% less zinc than the recaptured phosphoric acid composition.

It was discovered that the MSA-containing compositions surprisingly caused less corrosion on various surfaces than the phosphoric acid and hydrochloric acid.

Example 11

To test the corrosion propensity of MSA and phosphoric acid on PVD surfaces, corresponding solutions were prepared and tested.

Compositions of the present invention were prepared including 6.48% active MSA.

Comparative compositions were prepared similarly to the above compositions except that the comparative compositions replaced the MSA with 20.5% active phosphoric acid concentrate.

The surfaces were spot tested covered and uncovered. The tests were run for 30 minutes at full product concentrate form and for 24 hours at full concentrate form, 6 oz/gallon and 8 oz/gallon dilutions. Two drops of each composition were dropped on 1 inch diameter watch glasses for the surface point of contact. The watch glasses were inverted to perform the covered spot tests and were upright to perform the uncovered spot tests. After the appropriate application time, the surfaces were rinsed with 5 grain per gallon water and wiped dry with a paper towel. If there were any changes, a standard liquid detergent was applied onto the surface which was then cleaned with a paper towel, rinsed and dried.

Corrosion of the surfaces were rated based on a scale of 0 to 2. 0 indicates that the surface was unaffected, 1 indicates that there was a temporary change in the surface but the change was removed by water and detergent, and 2 indicates that there was a permanent change in the surface that could not be removed by water and detergent.

Tables 22-25 list the corrosion ratings of each of the compositions on the PVD surface. Table 22 lists the 30 minute concentrate ratings, Table 23 lists the 24 hour concentrate ratings, Table 24 lists the 24 hour concentrate ratings at a 6 oz/gallon dilution and Table 25 lists the 24 hour concentrate ratings at an 8 oz/gallon dilution.

TABLE 22

(30 minute concentrate).

| | Covered | Uncovered |
|---|---|---|
| 6.48% MSA | 0 | 0 |
| 20.50% $H_3PO_4$ | 0 | 0 |

TABLE 23

(24 hour concentrate).

| | Covered | Uncovered |
|---|---|---|
| 6.48% MSA | 0 | 0 |
| 20.50% $H_3PO_4$ | 2 | 2 |

TABLE 24

(24 hour concentrate, 6 oz/gallon dilution).

| | Covered | Uncovered |
|---|---|---|
| 6.48% MSA | 0 | 0 |
| 20.50% $H_3PO_4$ | 2 | 2 |

TABLE 25

(24 hour concentrate, 8 oz/gallon dilution).

| | Covered | Uncovered |
|---|---|---|
| 6.48% MSA | 0 | 0 |
| 20.50% $H_3PO_4$ | 0 | 2 |

As can be seen in Tables 22-25, the compositions including MSA did not affect the PVD surface at any of the concentrations. While the compositions including 20.5% active phosphoric acid concentrate did not corrode the PVD surface at 30 minutes, the compositions did affect the surfaces when the compositions were applied for a longer period of time.

The composition including 20.5% active phosphoric acid concentrate permanently changed the PVD surfaces at a 24 hour concentrate exposure and at a 24 hour concentrate exposure at a 6 oz/gallon dilution when the test substrate was covered or uncovered. At an 8 oz/gallon dilution, the surface was unaffected when covered, but exhibited corrosion when uncovered.

It was discovered that the MSA-containing compositions surprisingly caused less corrosion on PVD surfaces than the phosphoric acid.

Disinfectant Efficacy

Example 12

A disinfectant efficacy test was performed using a disinfectant including MSA against *Staphylococcus aureus* and *Pseudomonas aeruginosa*. The organic soils used were 5% Fetal Bovine Serum and 0.005% sodium stearate. The neutralizer/subculture media was 10 mL Letheen broth with Tryptone glucose extract agar for bacterial enumeration. The bacteria was incubated at about 35° C. for about 48±4 hours and about 35° C. for about 24 hours for subculture. The bacteria was exposed to the disinfectants for about 10 minutes at ambient temperature.

The test solution included a commercially available disinfectant including 6.48% active MSA and was diluted with 400 ppm hard water to either 6 oz/gallon or to 8 oz/gallon concentrations.

The test method used was AOAC Use-Dilution Method.

For a product to pass the disinfectant efficacy test, no less than 59 of the 60 tubes tested must be negative for each organism.

Table 26 lists the test system, concentration and number of negative tubes per number of carriers tested.

TABLE 26

| Test System | Concentration | * Negative Tubes/#carriers tested | Pass/Fail |
|---|---|---|---|
| *Staphylococcus aureus* | 6 oz/gallon | 59/60 | Pass |
| *Pseudomonas aeruginosa* | 6 oz/gallon | 59/60 | Pass |
| *Staphylococcus aureus* | 8 oz/gallon | 59/60 | Pass |
| *Pseudomonas aeruginosa* | 8 oz/gallon | 60/60 | Pass |

As can be seen in Table 26, the composition containing MSA did not effect the disinfecting ability of a known disinfecting composition against *Staphylococcus aureus* or *Pseudomonas aeruginosa*. At both 6 oz/gallon and 8 oz/gallon concentrations, the composition passed.

It was discovered that the MSA-containing compositions did not affect the ability of known compositions against *Staphylococcus aureus* and *Pseudomonas aeruginosa*.

Example 13

A disinfectant efficacy test was performed using a disinfectant including MSA against *Staphylococcus aureus* and *Salmonella enterica*. The neutralizer/subculture media used was 10 mL Letheen broth. The bacteria was incubated at about 35° C. for about 48±4 hours. The bacteria was exposed to the disinfectants for about 10 minutes at ambient temperature.

A first set of compositions (Composition C) included 5.6% active MSA, 3% active quaternary ammonium chloride, 1.5% active alcohol ethoxylate and balance softened water. A second set of compositions (Composition D) similar to the above samples were also prepared including 5.6% active MSA, 3% active quaternary ammonium chloride, 1.5% active alkyl polyglucoside and balance softened water. The test solutions were diluted with deionized water to either 2 oz/gallon or to 4 oz/gallon concentrations. The methane sulfonic acid used in the samples included 6.48% active MSA.

The test method used was AOAC Use-Dilution Method.

For a product to pass a disinfectant test, no less than 59 of the 60 tubes tested must be negative for each organism. Because only 20 carriers were tested, the numbers were multiplied by 3 to simulate testing 60 carriers.

Table 27 lists the concentration, test system and number of negative tubes per number of carriers tested.

TABLE 27

| | Test System | Concentration | #Negative Tubes/#Carriers Tested | Pass/Fail |
|---|---|---|---|---|
| Composition C | *Staphylococcus aureus* | 2 oz/gallon | 0/20 | Fail |
| | *Salmonella enterica* | 2 oz/gallon | 20/20 | Pass |
| Composition D | *Staphylococcus aureus* | 2 oz/gallon | 0/20 | Fail |
| | *Salmonella enterica* | 2 oz/gallon | 20/20 | Pass |
| Composition C | *Staphylococcus aureus* | 4 oz/gallon | 14/20 | Fail |
| | *Salmonella enterica* | 4 oz/gallon | 20/20 | Pass |
| Composition D | *Staphylococcus aureus* | 4 oz/gallon | 20/20 | Pass |
| | *Salmonella enterica* | 4 oz/gallon | 20/20 | Pass |

As can be seen in Table 27, a MSA-containing formula passed for disinfecting against *Staphylococcus aureus* and *Salmonella enterica*, demonstrating that it is possible to formulate an effective disinfectant using MSA and a quaternary ammonium chloride.

Sanitizing Efficacy

Example 14

A sanitizing efficacy test was performed using a sanitizer including MSA against *Staphylococcus aureus* and *Klebsiella pneumoniae*. The carriers were placed in a 1 inch by 1 inch sterile stainless steel container at a temperature of about 35±2° C. for about 30 minutes. The inoculum volume was about 0.02 mL. A neutralizer of 20 mL of D/E broth was also used. Prior to adding the neutralizer a neutralizer screen was performed to verify that the neutralizers adequately neutralized the test substances and were not detrimental to the tested organisms. There was a $10^0$ dilution due to a 5 mL test substance and the 20 mL neutralizer used in the test. The incubation period was about 48 hours at about 35° C.

One set of compositions (Composition E) included 5.6% active MSA, 3% active quaternary ammonium, 1.5% active alcohol ethoxylate and balance softened water. A second set of compositions (Composition F) similar to the above compositions were also prepared including 5.6% active MSA, 3% active quaternary ammonium, 1.5% active alkyl polyglucoside and balance softened water. The test solutions were diluted with deionized water to either 2 oz/gallon or to 4 oz/gallon concentrations. The test solutions included 6.48% active MSA.

The count of *Staphylococcus aureus* suspension used to inoculate the coupons was $6.8\times10^8$ CFU/mL. The count of *Klebsiella pneumoniae* suspension used to inoculate the coupons was $1.1\times10^9$ CFU/mL.

The test method used EPA DIS/TSS-10 Sanitizer Test for Inanimate, Non-Food Contact Surfaces.

For a product to pass a sanitizing test, the bacteria must be reduced by at least 99.9% or by a 3 log reduction.

Table 28 lists the details for the *Staphylococcus aureus* sanitizing test for the compositions and Table 29 lists the details for the *Klebsiella pneumoniae* sanitizing test for the compositions.

TABLE 28

(*Staphylococcus aureus*).

| | Dilution | Trial | Survivors/Plate | Total Organisms Surviving per Coupon (×25) | Log10 | Geometric Mean | Percent Reduction (%) |
|---|---|---|---|---|---|---|---|
| Comp. E | 2 | 1 | 96 | $2.4 \times 0^3$ | 3.38 | $2.2 \times 10^3$ | 99.96 |
| | | 2 | 160 | $4.0 \times 10^3$ | 3.60 | | |
| | | 3 | 53 | $1.3 \times 10^3$ | 3.12 | | |
| | | 4 | 216 | $5.4 \times 10^3$ | 3.73 | | |
| | | 5 | 33 | $8.2 \times 10^2$ | 2.92 | | |
| Comp. E | 4 | 1 | 33 | $8.2 \times 10^2$ | 2.92 | $8.1 \times 10^2$ | 99.98 |
| | | 2 | 48 | $1.2 \times 10^3$ | 3.08 | | |
| | | 3 | 28 | $7.0 \times 10^2$ | 2.84 | | |
| | | 4 | 33 | $8.2 \times 10^2$ | 2.92 | | |
| | | 5 | 25 | $6.2 \times 10^2$ | 2.80 | | |
| Comp. F | 2 | 1 | 121 | $3.0 \times 10^3$ | 3.48 | $7.1 \times 10^2$ | 99.98 |
| | | 2 | 56 | $1.4 \times 10^3$ | 3.15 | | |
| | | 3 | 113 | $2.8 \times 10^3$ | 3.45 | | |
| | | 4 | 6 | $1.5 \times 10^2$ | 2.18 | | |
| | | 5 | 4 | $1.0 \times 10^2$ | 2.00 | | |
| Comp. F | 4 | 1 | 27 | $6.8 \times 10^2$ | 2.83 | $4.6 \times 10^2$ | 99.99 |
| | | 2 | 13 | $3.2 \times 10^2$ | 2.51 | | |
| | | 3 | 17 | $4.2 \times 10^2$ | 2.63 | | |
| | | 4 | 19 | $4.8 \times 10^2$ | 2.68 | | |
| | | 5 | 19 | $4.8 \times 10^2$ | 2.68 | | |

TABLE 29

(*Klebsiella pneumoniae*).

| | Dilution | Trial | Survivors/ Plate | Total Organisms Surviving per Coupon (×25) | Log10 | Geometric Mean | Percent Reduction (%) |
|---|---|---|---|---|---|---|---|
| Comp. E | 2 | 1 | 0 | <25 | <1.40 | $<2.5 \times 10^1$ | 99.99 |
| | | 2 | 0 | <25 | <1.40 | | |
| | | 3 | 0 | <25 | <1.40 | | |
| | | 4 | 0 | <25 | <1.40 | | |
| | | 5 | 0 | <25 | <1.40 | | |
| Comp. E | 4 | 1 | 0 | <25 | <1.40 | $<8.6 \times 10^1$ | 99.98 |
| | | 2 | 0 | <25 | <1.40 | | |
| | | 3 | 496 | $1.2 \times 10^4$ | 4.09 | | |
| | | 4 | 0 | <25 | <1.40 | | |
| | | 5 | 0 | <25 | <1.40 | | |
| Comp. F | 2 | 1 | 1 | 25 | 1.40 | $3.9 \times 10^1$ | 99.99 |
| | | 2 | 1 | 25 | 1.40 | | |
| | | 3 | 0 | <25 | <1.40 | | |
| | | 4 | 5 | $1.2 \times 10^2$ | 2.10 | | |
| | | 5 | 2 | $5.1 \times 10^1$ | 1.70 | | |
| Comp. F | 4 | 1 | 0 | <25 | <1.40 | $<2.5 \times 10^1$ | 99.99 |
| | | 2 | 0 | <25 | <1.40 | | |
| | | 3 | 0 | <25 | <1.40 | | |
| | | 4 | 0 | <25 | <1.40 | | |
| | | 5 | 1 | 25 | 1.40 | | |

As can be seen in Tables 28 and 29, a MSA-containing formula passed for sanitizing against *Staphylococcus aureus* and *Klebsiella pneumoniae*, demonstrating that it is possible to formulate an effective sanitizer using MSA and a quaternary ammonium chloride.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

All publications and patent applications in this specification are indicative of the level of ordinary skill in the art to which this invention pertains.

The invention has been described with reference to various specific and preferred embodiments and techniques. However, it should be understood that many variations and modifications may be made while remaining within the spirit and scope of the invention.

The following is claimed:

1. A concentrate cleaning composition for removing soil from a hard surface, consisting of:

(a) about 1 to about 70 wt % of methane sulfonic acid;

(b) about 0.1 to about 15 wt % of a surfactant;

(c) up to about 90% of a solvent;

(d) substantially free of phosphorous-containing compounds;

(e) about 5 to about 20 wt % octanoic acid and linear alkylbenzene sulfonate; and (f) the cleaning composition is effective for removing limescale from a hard surface.

2. The composition of claim 1, wherein the composition comprises less than about 10% active methane sulfonic acid.

3. The composition of claim 2, wherein the composition comprises less than about 6% active methane sulfonic acid.

* * * * *